United States Patent [19]

Trass

[11] Patent Number: 4,730,787

[45] Date of Patent: Mar. 15, 1988

[54] METHOD OF SEPARATING SOLIDS BY SIMULTANEOUS COMMINUTION AND AGGLOMERATION

[75] Inventor: Olev Trass, Toronto, Canada

[73] Assignee: The University of Toronto Innovations Foundation, Toronto, Canada

[21] Appl. No.: 622,340

[22] Filed: Jun. 19, 1984

[51] Int. Cl.[4] ..... B02C 23/18

[52] U.S. Cl. ..... 241/15; 241/20; 241/21; 241/24

[58] Field of Search ..... 209/5; 241/14, 15, 20, 241/21, 24

[56] References Cited

U.S. PATENT DOCUMENTS

| | | | |
|---|---|---|---|
| 3,268,071 | 8/1966 | Trass | 209/5 |
| 4,284,413 | 8/1981 | Trass | 44/51 |
| 4,396,396 | 8/1983 | Mainwaring | 241/20 X |

FOREIGN PATENT DOCUMENTS

| | | |
|---|---|---|
| 1020880 | 11/1977 | Canada . |
| 1117884 | 3/1982 | Canada . |

OTHER PUBLICATIONS

O. Trass, "Mineral Matter Liberation by Fine Grinding of Coal Using the Szego Mill", Nov. 1982.

*Primary Examiner*—Timothy V. Eley
*Attorney, Agent, or Firm*—Rogers, Bereskin & Parr

[57] ABSTRACT

A process is provided for the separation of a solid into its constituent lyophobic and lyophilic components by comminution and agglomeration in liquids to which the two components are respectively lyophobic and lyophilic. The process has particular application in coal beneficiation wherein ash particles are liberated into a water phase and coal particles are agglomerated with oil. The operations of comminuting and agglomerating are combined in a single step by performing the process in a mill having positive transport capability.

27 Claims, 8 Drawing Figures

METHOD OF SEPARATING SOLIDS BY SIMULTANEOUS COMMINUTION AND AGGLOMERATION

The present invention relates to the separation of a solid, by comminution and agglomeration into its constituent lyophobic and lyophilic components.

It is often desirable to separate a solid having lyophilic and lyophobic components into said components for cleaning or beneficiating purposes. One of the most frequent purposes for such a process is for beneficiating coal or coal-water slurries to reduce the ash content of same. Beneficiated coal slurries are used as combustion fuels and have the advantages of having increased heating value, lower sulphur content, reduced abrasion, and minimized ash handling and boiler derating.

Established coal cleaning methods include washing, heavy media separation, flotation, and more recently, a "spherical agglomeration technique". The latter technique was developed at the National Research Council of Canada (NRCC), and is described in the literature, see for example Canadian Pat. No. 1,117,804 issued Feb. 9, 1982, to Capes et al, entitled "In-Line Method for the Beneficiation of Coal and the Formation of a Coal-in-Oil Combustible Fuel Therefrom". This proces is presently thought of as the best available method of cleaning and recovering very fine coal particles.

Briefly, the NRCC process involves contacting a finely ground coal in a water medium with an oil or hydrocarbon solvent and then intensely mixing the mixture to break the oil into fine droplets and to allow the hydrophobic coal particles to collect onto these droplets. The hydrophilic ash constituents are left behind in the water. This step is followed by a period of milder stirring to allow the coal-oil particles to grow into larger spherical agglomerates, with the oil acting as a binding liquid. These agglomerates can then be separated from the aqueous phase by screening.

Studies on the NRCC process, using a high ash (20%) Minto coal from Chatham, New Brunswick showed that the coal must first be comminuted or ground to about a 10 μm median size range in order for the process to give good ash liberation. For this purpose, a ball mill followed by a stirred media mill was used to give, depending on the conditions, an ash reduction down to about the 10% range.

The equipment thus typically needed for the successful operation of the NRCC process includes a coarse grinding mill, a fine grinding mill, an intensive high shear mixing system, a low shear mixing tank and a separating screen. The NRCC process therefore uses multiple vessels and multiple steps to achieve comminution and agglomeration of high ash coals. Furthermore, grinding is a relatively inefficient operation. The energy consumption is large and considerable energy is wasted in moving the mill and the materials therein. Only a small fraction of the energy is required for the actual size reduction.

It is therefore desirable to minimize the wasting of this grinding energy, for example, by utilizing the energy in the mixing, coal oil contacting, and agglomerating stages. However, the problem arises that with most conventional grinding equipment, for example ball mills, sticky, paste-like agglomerates form which do not move through the mill.

The inventor has discovered that, in a process in which it is desirable to separate a solid into its constitutent lyophobic and lyophilic components, it is possible to combine the comminution and agglomeration operations by performing these steps in a mill having positive transport capability. The combining of these two operations reduces the energy and equipment needed for the separation process.

For the purpose of this specification, a mill having positive transport capability will be understood as described hereinafter. A mill that has a movable channel, so that it is capable of transporting cohesive mixtures, is said to have a transport capability. If the channels are arranged to transport the mixture through the mill in the direction of flow to assist gravity or whatever other agency feeds the mixture into and out of the mill, in the absence of a pressurized feed, the transport is termed positive.

The mill, in addition to having positive transport capability, will preferably be a high speed, high shear mill.

An exemplary and preferred high speed, high shear, positive transport mill is described in Canadian Patent issued Dec. 25, 1979, to General Comminution Inc. and entitled "Comminution Device". The mill is known in the art as the Szego Mill.

In accordance with a broad aspect of the present invention, there is provided a process for separating a solid having two or more components, at least one of which is lyophobic and at least one of which is lyophilic. The process comprises, in a single step, comminuting a mixture of the solid in a first liquid to which one of the components is lyophilic and to which the other component is lyophobic and in a second liquid which is immiscible with the first liquid and which will wet the lyophobic component to form agglomerates of the lyophobic component and the second liquid in a mill having positive transport capability; and thereafter, the further step of separating the agglomerates from the mixture. Typically, the components of the solid to be separated will be hydrophobic and hydrophilic, and thus the liquids used will be water and a liquid immiscible with water, for example a hydrocarbon or oil, which wets and agglomerates the hydrophobic component.

In accordance with another aspect of the invention there is provided a process for beneficiating coal containing ash. The process comprises, in a single step, comminuting a mixture of coal, water and oil to liberate at least a portion of the ash and coal in particulate form, and to form agglomerates of the coal particles and the oil in a mill having positive transport capability; and thereafter, the further step of separating the agglomerates from the mixture.

The invention will now be further described, with reference to exemplary embodiments, as illustrated in the accompanying drawings in which FIG. 1 is a schematic flow diagram showing the prior art NRCC coal beneficiation process and the simultaneous comminution and agglomeration process of this invention;

FIG. 4 is a graph comparing particle size reduction between two phase coal-water grinding and three phase coal-water-oil grinding;

FIG. 5 is a graph comparing the particle size reduction when grinding in two phase coal-water and three phase coal-water-oil with varying percent solids contents.

FIGS. 6 and 7 are graphs showing the effect on percent ash reduction of varying the coal-water ratio, at oil-to-coal ratios of 0.12 and 0.20; and FIG. 8 is a graph showing the effect on percent ash reduction of varying the coal-oil ratio, at a water-to-coal ratio of 1.0.

It will be understood that the process of the present invention has application whenever it is desired to separate a solid such as a mineral or a metal having at least one lyophobic and at least one lyophilic component. The liquids used for the separation, together with the operating parameters of the process, will vary according to the properties of the particular solid being separated. However, the process will involve comminuting the solid in a first liquid to which one of the components is lyophilic and to which the other component is lyophobic and in a second liquid which is immiscible with the first liquid and which will wet the lyophobic component. If the components are hydrophilic and hydrophobic, as will usually be the case, the first liquid will be water and the second liquid will preferably be a hydrocarbon such as an oil, which is immiscible with water.

The process will now be described in accordance with the preferred embodiment of coal beneficiation, however, it will be understood that the invention is not so limited.

Figure 1:
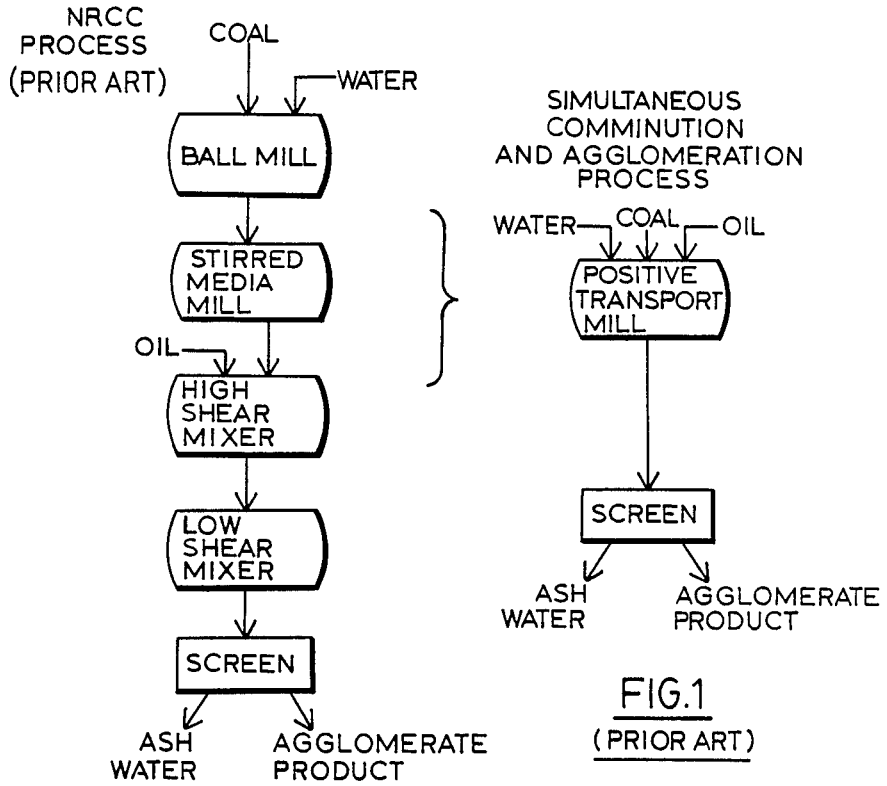
FIG.1 (PRIOR ART)

The process is shown schematically in FIG. 1. A coal containing ash, in a particulate form, together with water and oil, is fed into a mill having positive transport capability. In the mill this mixture is comminuted to liberate the ash component, in particulate form, into the water phase and to form agglomerates of the coal particles with oil. The mixture containing the agglomerates is then removed from the mill and the agglomerates are separated on an appropriate mesh screen to produce an ash-water stream and a coal-oil agglomerate product.

Figure 3:
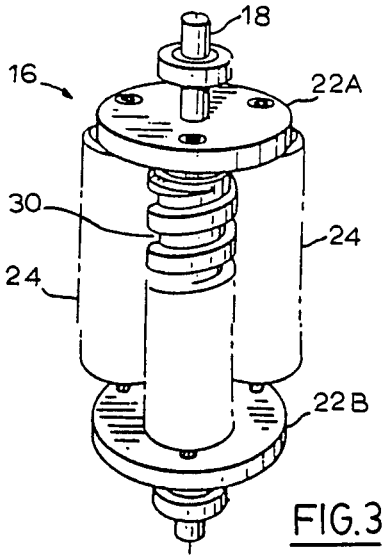
FIG. 3 is a perspective view of part of the mill of FIG. 2.
Figure 2:
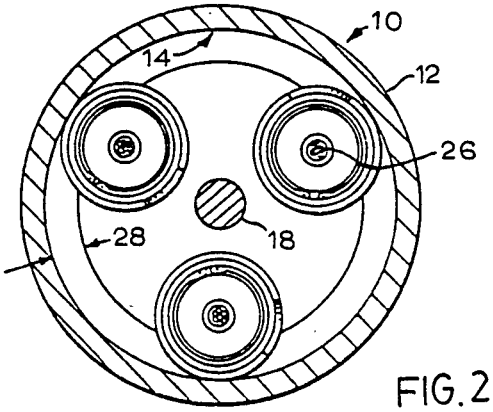
FIG. 2 is a plan view in section of a mill having positive transport capability.

An exemplary mill having positive transport capability is shown in FIGS. 2 and 3. The mill is known in the art as the Szego mill and will be only briefly described herein.

The mill 10 comprises a housing 12 forming an inner stationary, cylindrical grinding surface 14. A rotary assembly 16 is located within the housing 12 and includes a central shaft 18 rotatably driven by a motor (not shown). Keyed to the shaft 18 are upper and lower drive plates 22A and 22B respectively. Mounted vertically between the drive plates 22A, 22B are three helically grooved rollers 24. The rollers 24 rotate freely with respect to the plates 22A, 22B about axes parallel to the shaft 18. To that end, the rollers 24 are suspended on vertical shafts 26 rotatably connected to the plates 22A, 22B, such that they are flexibly movable with respect to the grinding surface for radial mobility.

When the shaft 18 and plates 22A, 22B are rotated, the rollers 24 roll around the grinding surface 14. The flexible connection allows the rollers 24 to press against the surface 14 as a result of the centrifugal force of rotation.

In operation, the solids and liquids, here coal, oil and water, to be comminuted and agglomerated are fed by gravity into the top of the mill 10 through the drive plate 22A from a feed cylinder (not shown). The mixture falls down into the annular gap 28 between the plate 22A and the surface 14; is comminuted by the rollers 24 against the surface 14 as it passes through the mill; forms agglomerates as the solid is comminuted and transported downwardly through the mill; and is discharged from the mill through the gap (not shown) between the bottom plate 22B and the surface 14.

The mill 10 has positive transport capability as called for in the invention, in that the rollers 24 are each formed with a helical groove 30. The action of the groove causes comminuted particles to move downwardly in the mill and thus moves the mixture throuqh the mill.

This positive transport capability thus provides a means for controlling the residence time and thus the degree of comminution and agglomeration achieved within the mill. Most importantly, the positive transport capability allows one to form agglomerates within the mill without the mill becoming plugged, something which readily happens if the same operation is attempted in an agitated media mill.

The mill 10 has been found to have the further benefit of improved ash liberation. The rolling action of the mill generally results in the formation of flaky rather than spherical particles. Spherical particles typically result from the NRCC prior art process with grinding in a ball mill and/or a stirred media mill. Ash liberation depends on the exposed surface area of the comminuted particle. Thus, with flaky particles, improved ash liberation results, since the flake thickness is more important than the flake diameter, the commonly measured parameter. Stated in another way, for good ash liberation and removal, it is not necessary to grind as fine in the positive transport mill as in a ball mill.

The hydrocarbon or oil used in the process will be immiscible with water and will wet the hydrophobic coal particles. The choice of hydrocarbon or oil will depend on the type of coal used, the availability of suitable liquids, and of course the desired efficiency and economics of the process. Preferred liquids include light oils, for example, No. 2 fuel oil, diesel oil, light petroleum fractions, kerosene, coke oven light oil, light crude, and residual and waste oils.

The amounts of oil and water included in the process will vary with the type of feedstock, the type of coal, the purpose of the process, and the desired economics and efficiency of the process. In both cases, however, there should be included sufficient oil and water to cause agglomerates to form.

For the purpose of this specification, the values given for water, oil and coal content are, unless otherwise specified, by weight based on the total mixture.

When the process is used to beneficiate an ash-containing coal, the process parameters will vary with the purpose of the process. For instance, if the purpose is to produce a relatively dry agglomerate it is preferable to use a high percentage of oil, typically in the range of about 5 to 10%. A lesser amount of oil is used, for example about 3 to 5%, if it is desired to minimize costs. The amount of water used is preferably at least about 40% and more preferably about 45 to 55%. Depending on the coal type and the fineness of comminution at less than about 35 to 40% water, a thick pasty mixture may form in the mill. In such a mixture agglomeration in a continuous water phase is not readily discernable. One should, therefore, preferably conduct the process at a water content above this level. If the coal is very finely comminuted more water is needed.

The feedstock to be separated may alternatively be a stream recovered from a coal tailings pond. When coal has been sitting in a pond for a number of years, the coal surface becomes oxidized and is more hydrophilic than a fresh coal surface. The comminution step of this process exposes fresh coal surfaces which then respond to agglomeration in the mills with the same amounts of oil and water as stated above.

The feedstock to be separated may be a very dilute coal-water slurry, for instance a coal tailings stream which is normally pumped from a coal preparation plant to a tailings pond. Such a tailings stream typically comprises about 90% water and 10% coal. When this dilute feedstock is treated in accordance with this process, the addition of about 1 to 2% by weight oil, or not less than that needed to give a coal-to-oil ratio of 0.05, is sufficient to form agglomerates.

The mixture discharged from the mill is separated on a screen having a mesh size to retain most of the agglomerates. Once the free water and ash are removed, it is preferable to stir the agglomerates in another vessel with fresh water to allow further ash liberation. This final mixture is then passed through another screen to produce agglomerates significantly reduced in ash.

To produce a combustible fuel, the separated agglomerates may be treated with a detergent or surface active agent to produce a homogeneous coal-oil-water slurry, as is well known in the art. To reduce the sulphur dioxide emission following the combustion of this slurry fuel product, limestone, in particulate form, may be added during the preparation of the fuel. To that end, a final fuel preparation step may be carried out in a second Szego mill wherein the agglomerates, the detergent additive and the particulate limestone are passed through the mill.

The following examples are included to demonstrate the operability, efficiency and preferred operating parameters of the process.

EXAMPLE I

To demonstrate the grinding (comminuting) efficiency of the p rocess and the effect of solids content on the process, a number of coal samples were passed through a positive transport mill in a two-phase, coal-water slurry and in a threephase, coal-oil-water slurry. The procedure was as follows:

A Szego mill of 22 cm diameter size, equipped with four, 30 cm long, fine-grooved rollers, was used. It was operated at a constant rotational speed of 800 rpm. The coal used was a Minto coal from New Brunswick. The coal was hard, having a Hardgrove index of 65. It contained about 26% finely dispersed ash (reported to be liberated at a size of about 10 μm). The feed coal was initially crushed to a size of about −4 mm. The oil used was No. 2 fuel oil. Five kilograms of coal were fed into the mill at a feed rate of 270 kg/hr on a dry basis. The oil-to-coal ratio and water-to-coal ratios were varied between 0.1 and 0.36 and between 0.5 and 1.7 respectively.

The products discharged from the mill were collected, weighed and analyzed. A sieve analysis was used for the particle size range of 63 μm and greater. The sample products were washed with varsol and then with detergent and water. A HIAC® model PC320 analyzer with a 60 μm sensor was used for smaller particles.

The ash analysis paralleled the ASTM D 2760 technique. Approximately 1 g of dried agglomerates was used in a crucible. The temperature was raised to 500° C. during the first hour, then to 750° C. for at least an additional hour.

Figure 4:
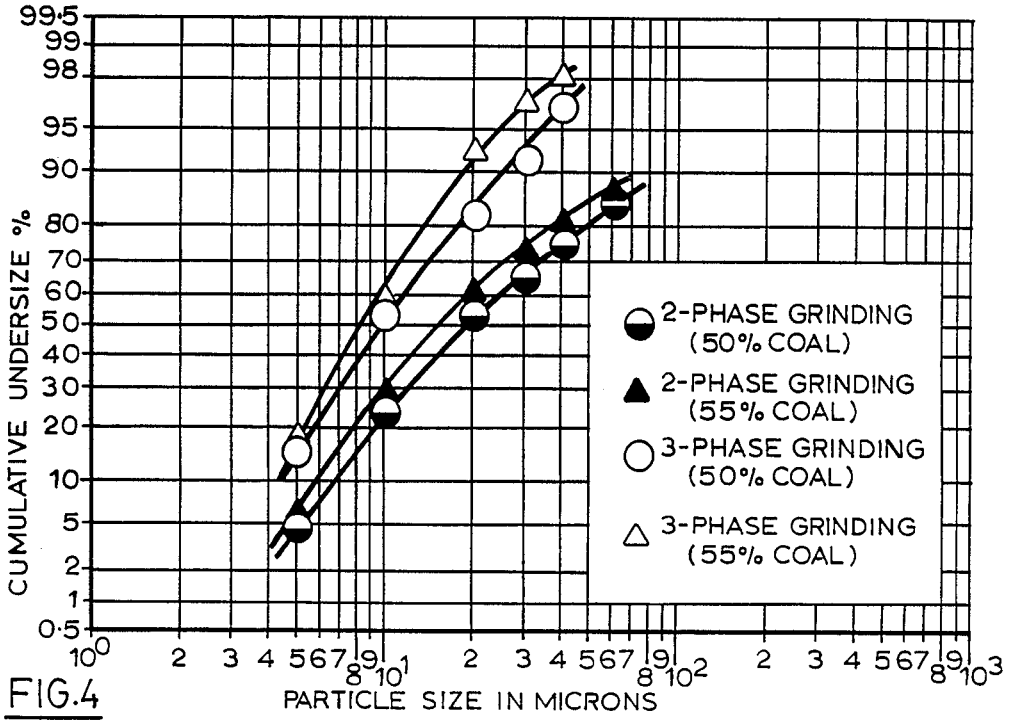
FIGS. 4–8 are graphs showing the effect of several parameters on the process of this invention, and more particularly.

The particle size distribution for two-phase and three-phase grinding is compared in FIG. 4. It will be noted that the efficiency of grinding at both 50 and 55% coal was improved in the three-phase grinding, that is, a finer product was achieved. While not being bound by the same, it is believed that the reason for the improved performance is the high local solids concentration within the agglomerates, and the resultant very high viscosity. Thus, while the crushing action of the mill is unlikely to change, a great deal of the fine grinding occurs by shearing and particle-particle attrition inside the agglomerates.

Figure 5:
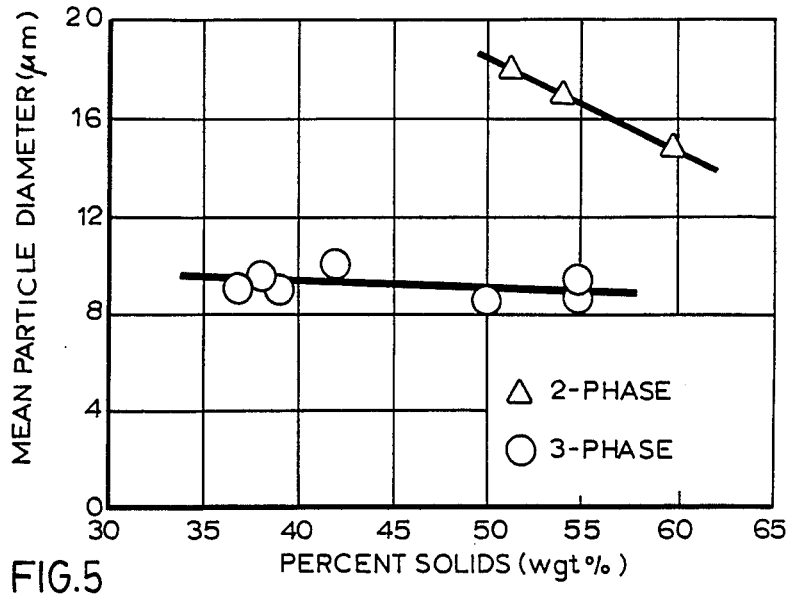

The mean particle size distribution of the product as a function of solids content in the mill is shown in FIG. 5. It will be noted that, whereas in the two-phase solids grinding, a lower solids content results in less efficient grinding, this effect is greatly reduced in three-phase grinding. While not being bound by the same, it is believed that the agglomerates are themselves subject to the grinding action in the mill. The agglomerates are generally sticky and their motion is thus likely to be inhibited. This then provides an increased residence time for the agglomerates within the mill, even though the water may travel more quickly through the mill.

A finer product is desirable in coal beneficiation. Firstly, a finer product will result in better ash liberation. Secondly, by increasing the amount of fresh hydrophobic surface area in the particles, better agglomeration can be achieved.

EXAMPLE II

Figure 6:
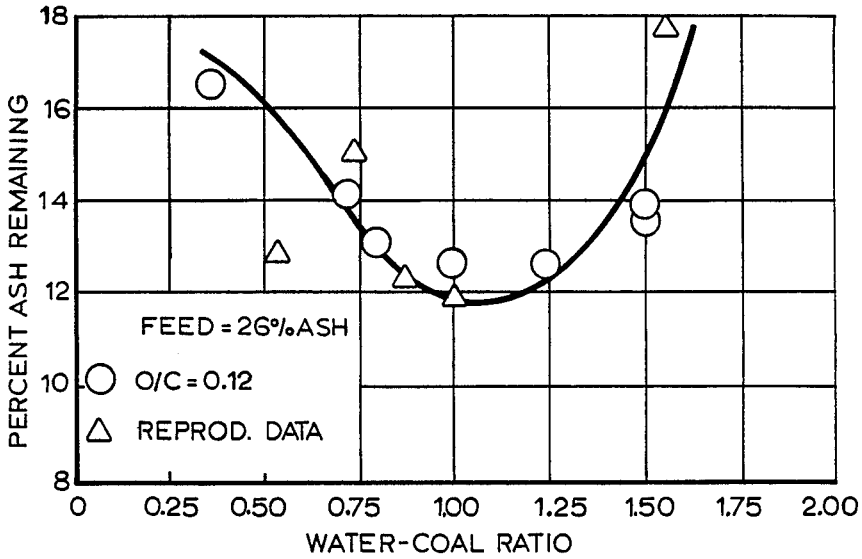
Figure 7:
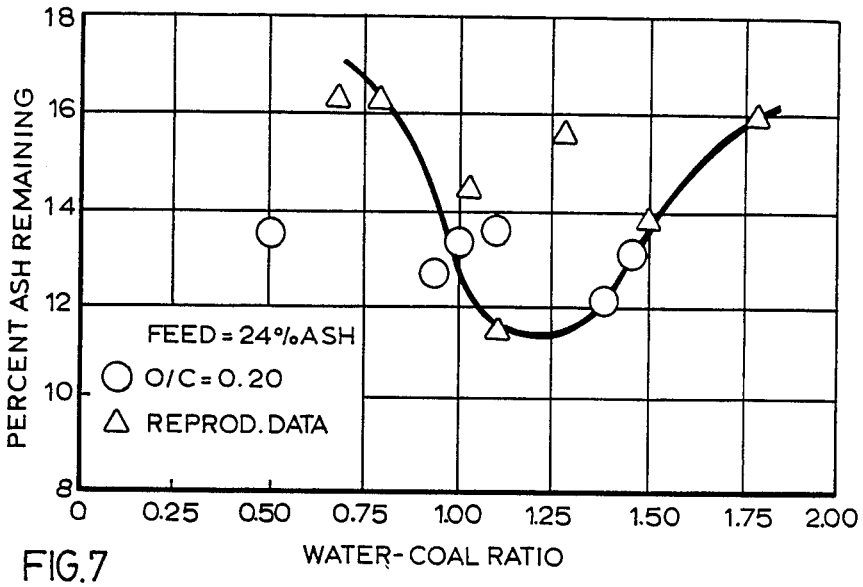

To demonstrate the effect of the water-to-coal ratio on the process, the procedure of Example I was repeated at oil-to-coal ratios of about 0.12 and 0.20 and varying water-to-coal ratios of about 0.4 to 1.7 (all numbers based on weight of total mixture). The results are shown in FIGS. 6 and 7 as percent ash reduction as a function of the water-to-coal ratio. The circles and triangles represent data accumulated at different times.

It will be noted that the preferred water content at both oil-to-coal ratios, was about 45–50% by weight of the total mixture. At lower water contents (less than about 40%) and higher water contents (more than about 60%) the proces efficiency drops off.

EXAMPLE III

Figure 8:
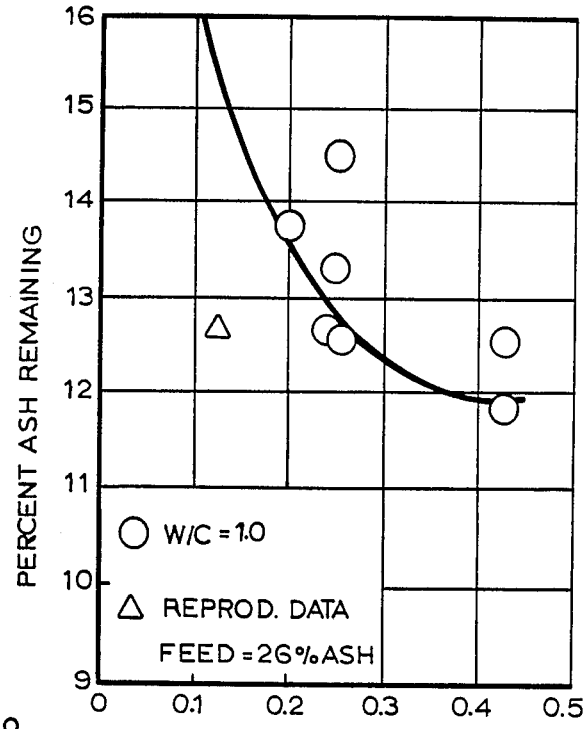

To demonstrate the effect of the oil-to-coal ratio on the process, the procedure of Example I was repeated at a water-to-coal ratio of 1.0 with oil-to-coal ratios varying from about 0.1 to 0.4. The results are shown in FIG. 8 as percent ash reduction as a function of the oil-to-coal ratio. The curve through the points was drawn partly relying on other cross-plots and knowing that, as the quantity of oil approaches zero, the ash level must approach the value of the feed.

It will be noted that use of large quantities of oil aids only marginally in ash removal, although it is known that large amounts of oil exclude water from the agglomerates. The use of oil may be minimized to reduce costs. An oil-to-coal ratio of 0.1 (5%) appears adequate, and still lower values (of about 3%) are effective in causing agglomeration.

The embodiment of the invention in which an exclusive property or privilege is claimed are defined as follows:

1. A process for separating a solid having two or more components, at leastone of which is lyophobic and at least one of which is lyophilic, comprising:

In a single step comminuting a mixture of the solid in a first liquid to which one of the components is lyophilic and to which the other component is lyophobic and in a second liquid which is immiscible with the first liquid and which will wet the lyophobic component to form agglomerates of the lyophobic component and the second liquid, in a mill having positive transport capability such that the mill causes the mixture to be transported therethrough; and thereafter, the further step of separating the agglomerates from the mixture.

2. The process as set forth in claim 1, wherein the solid is a coal containing coal and ash components.

3. The process as set out in claim 1, wherein the mill includes a stationary grinding surface and at least one roller adapted to rotate against the grinding surface, the roller having at least one helical groove such that rotation of the roller against the grinding surface creates at least one moveable channel in which to positively transport the mixture through the mill.

4. The process as set out in claim 3, wherein the solid is a coal containing coal and ash components.

5. The process as set out in claim 4, wherein the immiscible liquid is hydrocarbon.

6. The process as set out in claim 5 wherein the comminution and agglomeration is carried out in a Szgo mill.

7. A process for separating a solid having two or more components, at least one of which is hydrophobic and at least one of which is hydrophilic, comprising:

in a single step comminuting a mixture of the solid in water and liquid which is immiscible with water and which will wet the hydrophobic component to form agglomerates of the hydrophobic component and the immiscible liquid, in a mill having positive transport capability, such that the mill causes the mixture to be transported therethrough; and thereafter, the further step of separating the agglomerates from the mixture.

8. The process as set forth in claim 1 or 7 wherein the comminution and agglomeration is carried out in a high speed, high shear mill.

9. The process as set forth in claim 1 or 7, wherein the comminution and agglomeration is carried out in a Szego mill.

10. The process as set forth in claim 7, wherein the mill incldues a stationary grinding surface and at least one roller adapted to rotate against the grinding surface, the roller having at least one helical groove, such that rotation of the roller against the grinding surface creates at least one moveable channel in which to positively transport the mixture through the mill.

11. The process as set forth in claim 10, wherein the solid is a coal containing coal and ash components.

12. The process as set forth in claim 11, wherein the water is included in an amount sufficient to cause agglomeration.

13. The process as set forth in claim 12, wherein the water is included in an amount of at least about 40% by weight of the total mixture.

14. The process as set forth in claim 11, 12 or 13, wherein the comminution and agglomeration is carried out in a Szego mill.

15. The process as set forth in claim 13, wherein the immiscible liquid is an oil and is included in an amount sufficient to cause agglomeration.

16. The process as set forth in claim 15, wherein the oil is included in an amount of at least about 3% by weight of the total mixture.

17. The process as set forth in claim 16, wherein the oil is included in an amount not greater than about 10% of the total mixture.

18. The process as set forth in claim 15, wherein the oil is included in an amount not less than that needed to give a coal-to-oil ratio of about 0.05.

19. The process as set forth in claim 15, wherein the water is included in an amount of at least about 45% by weight, and the oil is included in an amount of at least about 5% by weight.

20. The process as set forth in claim 11, wherein the immiscible liquid is a hydrocarbon.

21. The process as set forth in claim 20, 15 or 19, wherein the comminution and agglomeration is carried out in a Szego mill.

22. A process for beneficiating a coal containing ash, comprising:

in a single step, comminuting a mixture of coal, water and oil to liberate at least a portion of the ash and coal in particulate form, and to form agglomerates of the coal particles and the oil in a mill having positive transport capability, such that the mill causes the mixture to be transported therethrough; and thereafter, the further step of separating the agglomerates from the mixture.

23. The process as set forth in claim 22, wherein the water is included in an amount of at least about 40% by weight of the total mixture, and the oil is included in an amount of at least about 3% by weight of the total mixture.

24. The process as set forth in claim 22, wherein the commminution and agglomeration is carried out in a high speed, high shear mill.

25. The process as set forth in claim 24, wherein the water is included in an amount of at least about 45% by weight, and the oil is included in an amount of at least about 5% by weight of the total mixture.

26. The process as set forth in claim 22 or 25, wherein the mill includes a stationary grinding surface and at least one roller adapted to rotate against the grinding surface, the roller having at least one helical groove, such that rotation of the roller against the grinding surface creates at least one moveable channel in which to positively tranport the mixture through the mill.

27. The process as set forth in claim 22 or 25 wherein the comminution and agglomeration is carried out in a Szego mill.

* * * * *